US009227389B1

(12) United States Patent
Zirilli

(10) Patent No.: US 9,227,389 B1
(45) Date of Patent: Jan. 5, 2016

(54) MIXING APPARATUS AND SYSTEMS FOR DAMPENING FLUID VAPOR DEPOSITION SYSTEMS USEFUL FOR INK-BASED DIGITAL PRINTING

(71) Applicant: XEROX CORPORATION, Norwalk, CT (US)

(72) Inventor: Francisco Zirilli, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/510,085

(22) Filed: Oct. 8, 2014

(51) Int. Cl.
*B41F 7/32* (2006.01)

(52) U.S. Cl.
CPC ..... *B41F 7/32* (2013.01)

(58) Field of Classification Search
CPC ..... B41F 7/24; B41F 7/32; B41F 7/37; B41F 33/0054; B41F 31/26; B41F 31/28; B41F 7/28; B41F 7/26; B41F 7/34; B41F 7/36; B41P 2200/22
See application file for complete search history.

(56) References Cited

U.S. PATENT DOCUMENTS

| | | | | |
|---|---|---|---|---|
| 4,394,870 | A * | 7/1983 | MacPhee | B01F 15/0458 137/99 |
| 6,293,199 | B1 * | 9/2001 | Gasparrini | B41F 7/32 101/216 |
| 2010/0229742 | A1 * | 9/2010 | Shinnishi | B41F 7/32 101/147 |
| 2012/0103212 | A1 | 5/2012 | Stowe et al. | |
| 2013/0033686 | A1 * | 2/2013 | Stowe | B41C 1/1033 355/30 |
| 2013/0033687 | A1 * | 2/2013 | Stowe | B41F 7/30 355/30 |

* cited by examiner

*Primary Examiner* — David Banh
(74) *Attorney, Agent, or Firm* — Ronald E. Prass, Jr.; Prass LLP

(57) ABSTRACT

An ink-based digital printing dampening fluid delivery system useful for printing with an ink-based digital printing system, the ink-based digital printing system having an imaging member is provided. The dampening fluid delivery system includes a supply chamber, a supply channel and a particularly-configured vapor mixing chamber. The vapor mixing chamber is in fluid communication with the supply chamber. The vapor mixing chamber interfaces with the supply chamber by way of a plurality of equally spaced, angled, small-diameter vapor exit ports for providing dampening fluid to be entrained in a flow of air provided to carry a uniform mass fraction distribution of the dampening fluid to be deposited on a reimageable surface of the imaging member.

20 Claims, 5 Drawing Sheets

MIXING APPARATUS AND SYSTEMS FOR DAMPENING FLUID VAPOR DEPOSITION SYSTEMS USEFUL FOR INK-BASED DIGITAL PRINTING

RELATED APPLICATION

The application is related to U.S. patent application Ser. No. 14/340,055, entitled "DAMPENING FLUID VAPOR DEPOSITION SYSTEMS FOR INK-BASED DIGITAL PRINTING," to Francisco Zirilli, filed on Jul. 24, 2014, the disclosure of which is hereby incorporated by reference herein in its entirety.

FIELD OF DISCLOSURE

This disclosure relates to ink-based variable data digital lithographic printing. In particular, the disclosure relates to printing variable data using an ink-based digital printing system that includes a dampening fluid vapor deposition system for enhanced dampening fluid delivery.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing as discussed in this disclosure uses a variable data digital lithography printing system, or digital offset printing system. A "variable data digital lithography system" is an image forming system that is configured for lithographic printing using lithographic inks and based on digital image data, which may be variable from one image to the next. "Variable data lithography printing," or "digital ink-based printing," or "digital offset printing" are terms that may be generally interchangeably employed to refer to the processes of lithographic printing of variable image data for producing images on a wide latitude of image receiving media substrates, the images being changeable with each subsequent rendering of an image on a substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the reimageable surface of the imaging member to an image receiving media substrate such as paper, plastic, or metal on which the image is printed. The reimageable surface of the imaging member may be then cleaned and used to form a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an inked image based on the dampening fluid pattern. The inked image may be partially cured as appropriate to adjust a rheology of the ink forming the inked image. The inked image may them be transferred to a printable image receiving media substrate. An objective is to achieve a transfer efficiency exceeding 95%. The reimageable surface of the imaging member from which the inked image is transferred is cleaned to remove residual ink and dampening fluid from the reimageable surface in preparation for forming a further image that may be different from a previous image, or based on different image data than the image data used to form the previous image. Such systems are disclosed in U.S. patent application Ser. No. 13/095,714 ("714 Application"), entitled "Variable Data Lithography System," filed on Apr. 27, 2011, by Timothy Stowe et al., which is commonly assigned, and the disclosure of which is hereby incorporated by reference herein in its entirety.

SUMMARY

Variable data lithographic printing system and process designs must overcome substantial technical challenges to enable high quality, high speed variable data digital lithographic printing. For example, digital architecture printing systems for printing with lithographic inks impose stringent requirements on subsystem materials, such as the reimageable surface of the imaging plate or imaging member, the ink used for developing the inked image, and the composition of the dampening fluid or the fountain solution in which the image is formed and on which the ink is deposited to form the inked image.

Fountain solutions or dampening fluids, such as octamethylcyclotetrasiloxane "D4" or cyclopentasiloxane "D5" may be applied to the reimageable surface of the imaging member that may be in the form of a printing plate or an intermediate transfer blanket. Subsequently, the applied layer of dampening fluid is image-wise vaporized according to image data to form a latent image in the dampening fluid layer, which may be about 0.5 microns in thickness, for example. During the laser imaging (vaporization) process, the base marking material layer is deposited in a uniform layer, and may spread across the background region, allowing subsequently applied ink to selectively adhere to the image regions. A background region may include D4 between the reimageable surface or plate and the deposited ink. A thickness of the dampening fluid layer may be preferably around 0.2 microns, or more broadly in a range of about 0.05 and about 0.5 microns.

The laser used to generate the latent image in the dampening fluid layer creates a localized high temperature region that is at about the boiling point of the dampening fluid, e.g., about 175° C. Accordingly, during the imaging process, large temperature gradients are formed on the reimageable surface of the imaging member in the imaged areas. The surface temperature rapidly decreases to ambient temperature away from the imaged areas or imaging zones, i.e., the portion of the reimageable surface of the imaging member on which the imaging (laser imaging) takes place.

Due to a motion of the reimageable surface of the imaging member during printing, dampening fluid vapor has been found to migrate over cooler regions of the reimageable surface, allowing the vapor to re-condense unevenly on the reimageable surface. If re-condensation occurs over an imaged region of the reimageable surface of the imaging member, streaks may appear in the formed or printed images. Dampening fluid vapor must be removed before it re-condenses on the reimageable surface of the imaging member.

A consistent thickness of a dampening fluid layer formed on the reimageable surface of an imaging member, and inhibiting a variability of the thickness of the disposed layer over the reimageable surface of the imaging member, or over the plate surface, is critical to effective high-quality image printing operations. To obtain a uniform dampening fluid layer thickness, reimageable surface or plate surface conditions must be satisfied. For example, under suitable conditions, a reimageable surface of the imaging member may be characterized by uniform temperature, a concentration of the dampening fluid may be uniform, and a mixture velocity tangential to the reimageable surface of the imaging member or imaging plate motion may be uniform.

As noted above, dampening fluid vapor systems and methods are disclosed in U.S. patent application Ser. No. 14/340,055 (the 055 application) that may include a dampening fluid manifold delivery system. The dampening fluid manifold delivery system disclosed in the 055 application may have an operating supply chamber diameter to printing area surface width ratio of less than 0.8. Mixed air and dampening fluid vapor may be caused to flow through a main supply chamber, and may be discharged onto a 100 mm wide reimageable surface of the imaging member at an angle of less than 30 degrees, for example, with a substantially uniform dampening fluid concentration, a substantially uniform mixture velocity, and a substantially uniform elevated temperature.

The mixed air and dampening fluid vapor may be introduced onto the imaging member surface at an angle of less than 30 degrees to minimize direct impingement of the elevated temperature jetted dampening fluid vapor into the reimagable surface in a manner that may detrimentally affect the reimagable surface or that may fail to promote even deposition of the dampening fluid on the reimageable surface. The introduction of the mixture onto the reimageable surface of the imaging member may be in a same substantially tangential direction as the rotation of the imaging member. As such, a speed of rotation of the reimageable surface of the imaging member may be maintained at, for example, 1000 mm/sec. A width of the imaging member surface or printing area may be widened by adjusting the manifold dimensions while maintaining a diameter to width ratio of less than 0.8.

The disclosed embodiments are specifically directed to a particular configuration of a mixing device for use in a dampening fluid vapor deposition system. The mixing device may be positioned upstream of a manifold connected dampening fluid vapor supply chamber to convey a mixture of air and dampening fluid vapor entrained in an airstream to the manifold connected dampening fluid vapor supply chamber.

A physical configuration on the mixing device may make it compatible and essentially contiguous with a physical configuration of the manifold connected dampening fluid vapor supply chamber. An objective of the disclosed embodiments is to deliver a uniform vapor mass fraction of the dampening fluid to the reimageable surface of the imaging member.

Exemplary embodiments may employ the particular configuration of the mixing device to pre-mix the dampening fluid vapor and the air before it is introduced into the distribution manifold as described in the 055 application.

In embodiments, the dampening fluid vapor enters a small chamber via a plurality of inlets to be subsequently introduced into the air stream in the interior of the mixing device via a number of small diameter holes spaced around a circumference of an air/vapor introduction conduit in fluid communication with the manifold connected dampening fluid supply chamber and distribution manifold. The disclosed configuration may produce a substantially uniform vapor mass fraction distribution at a small distance downstream in the airstream from several small diameter holes through which the dampening fluid vapor is introduced into the airstream in the mixing device.

Exemplary embodiments are described herein. It is envisioned, however, that any system that incorporates features of systems described herein are encompassed by the scope and spirit of the exemplary embodiments.

DETAILED DESCRIPTION

Figure 1:
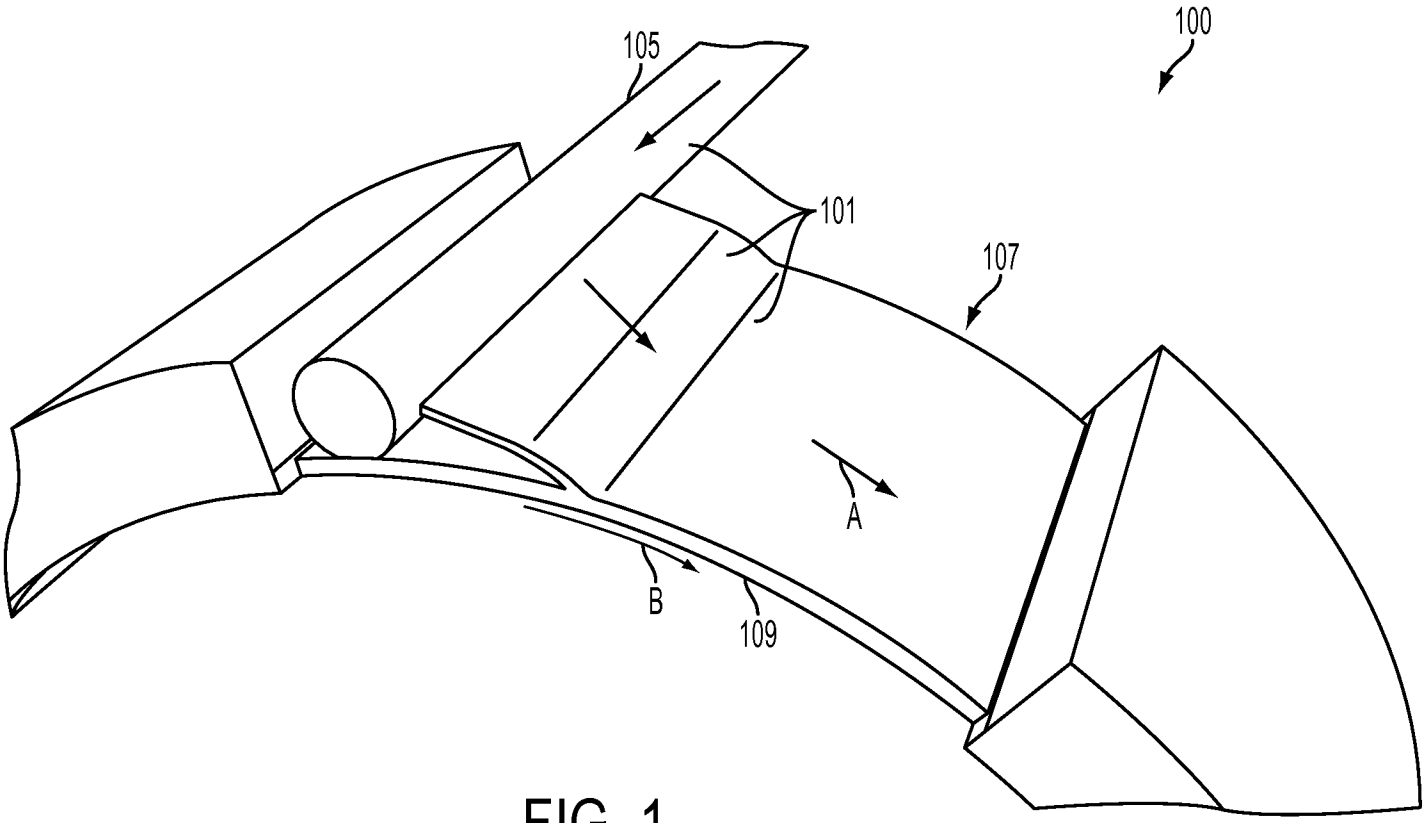
FIG. 1 illustrates a perspective view of a dampening fluid vapor deposition system, as described in the 055 application.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing, and ink-based digital printing system dampening fluid delivery/recovery systems. In the drawings, like reference numerals are used throughout to designate similar or identical elements. The drawings depict various embodiments of illustrative systems for depositing dampening fluid on a reimageable surface of an imaging member for ink-based digital printing.

In embodiments, the disclosed dampening fluid vapor deposition systems may include a supply manifold. The supply manifold may include a manifold connected dampening fluid vapor supply chamber. The supply manifold may include a supply channel that may be configured to enable flow of dampening fluid vapor from the manifold connected dampening fluid vapor supply chamber to the supply channel for ultimate delivery to the supply manifold. In particular, the manifold connected deposition fluid vapor supply chamber may include an interior portion that contains dampening fluid. The manifold connected dampening fluid vapor supply chamber may be formed in a tube-like shape, for example, and may be configured to communicate with a dampening fluid supply for receiving dampening fluid from the dampening fluid supply and delivering the dampening fluid to the supply manifold for deposition of the dampening fluid on the reimageable surface.

Dampening fluid may be delivered to an interior of the manifold connected dampening fluid vapor supply chamber at a first end of the tube-like structure of the manifold connected dampening fluid vapor supply chamber. The dampening fluid may flow from the first end of the manifold connected dampening fluid vapor supply chamber to one or more openings for communicating with the supply channel. The dampening fluid may flow from the manifold connected dampening fluid vapor supply chamber, through the supply channel, and out of the supply channel onto, for example, the reimageable surface of the imaging member.

FIG. 1 illustrates a perspective view of a dampening fluid vapor deposition system as described in the 055 application. In particular, FIG. 1 shows a vapor deposition system 100. The vapor deposition system 100 includes a dampening fluid manifold 101. The manifold 101 may include a manifold connected dampening fluid vapor supply chamber 105. The manifold connected dampening fluid vapor supply chamber 105 may be configured in the shape of a tube-like structure, for example. The manifold connected dampening fluid vapor supply chamber 105 may define an interior through which a dampening fluid vapor suitable for supporting ink-based digital lithographic printing may be supplied and directed to the manifold 101.

The manifold 101 may include a supply channel 107. The supply channel 107 may define an interior. The interior of the supply channel 107 may communicate with an interior of the manifold connected dampening fluid vapor supply chamber 105 to enable flow of the dampening fluid vapor from the manifold connected dampening fluid vapor chamber 105 to the supply channel 107 in direction A. The manifold connected dampening fluid vapor supply chamber 105 may be connected to a dampening fluid vapor supply via an air/vapor mixing device, which will be described in detail below, for receiving dampening fluid in an interior of the manifold connected dampening fluid vapor supply chamber 105. Dampening fluid may be caused to flow in direction A, through the manifold connected dampening fluid vapor supply chamber 105, to the supply channel 107, and through the supply channel 107 for depositing dampening fluid in a thickness controlled layer onto a reimageable surface of the imaging member 109 as the imaging member 109 translates the reimageable surface in direction B.

As shown in FIG. 1, the vapor deposition system 100 may be configured in an ink-based digital printing system for depositing dampening fluid on a reimageable surface of an imaging member or on a reimageable printing plate. In particular, the interior of the supply channel 107 may be configured to communicate with the reimageable surface of the imaging member 109 to deliver dampening fluid vapor to the reimageable surface at an angle of 30 degrees or less, and in a same tangential direction B as the movement of the reimageable surface of the imaging member 109. As the reimageable surface of the imaging member 109 rotates in a process direction B, dampening fluid is caused to flow from the interior of the supply channel 107 to the reimageable surface of the imaging member 109. Preferably, a ratio of the cross sectional area of the supply channel 107 to the cross sectional area of the tub-like structure of the manifold connected dampening fluid vapor supply chamber 105 is 0.8.

Figure 2:
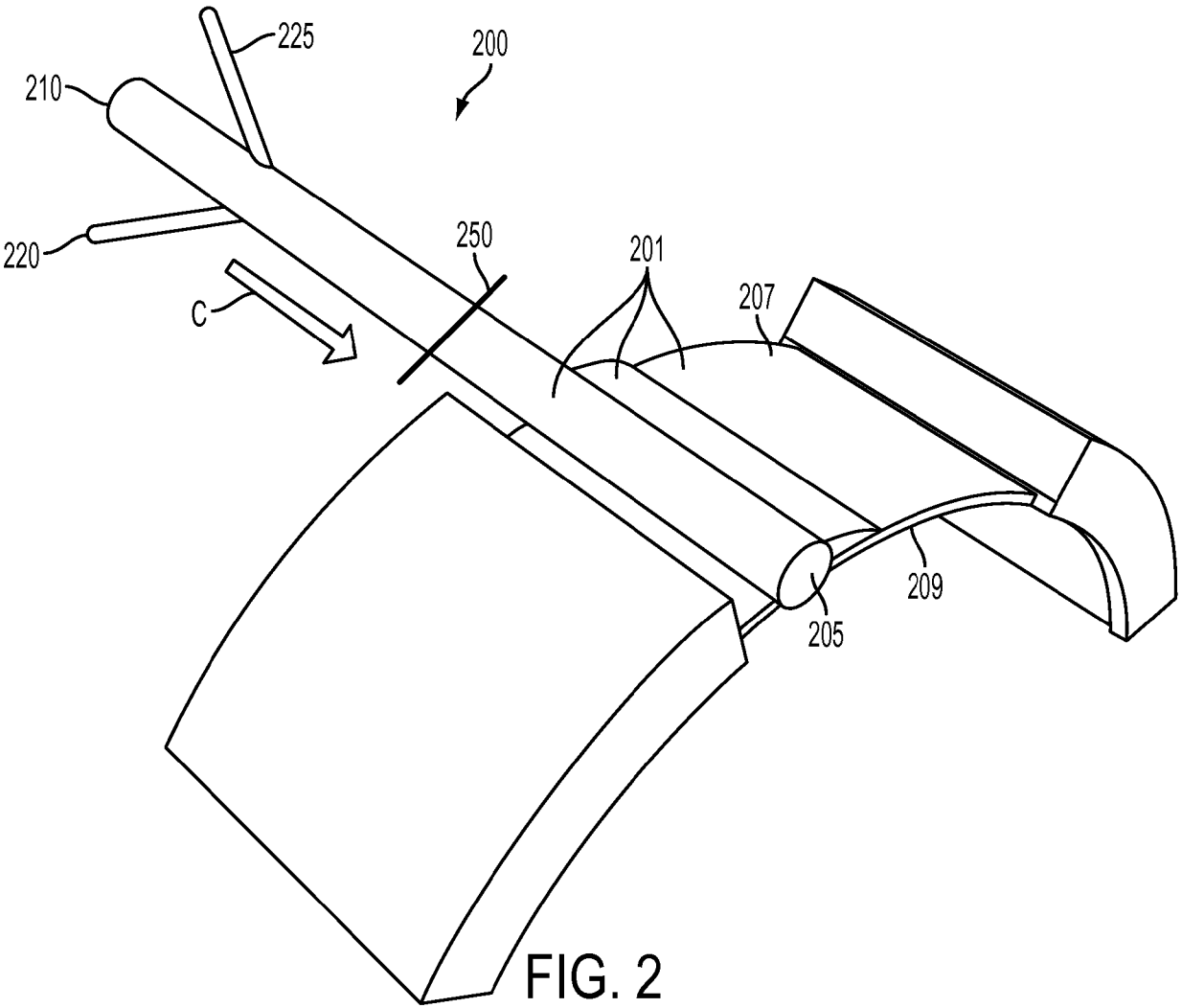
FIG. 2 illustrates an expanded perspective view of the dampening fluid vapor deposition system, as described in the 055 application, including an air/vapor introduction conduit in fluid communication with the distribution manifold.

FIG. 2 illustrates an expanded perspective view of the dampening fluid vapor deposition system 200 as described in the 055 application including an air/vapor introduction conduit in fluid communication with manifold connected dampening fluid vapor supply chamber and the distribution manifold. The vapor deposition system 200 may include a dampening fluid manifold 201. The dampening fluid manifold 201 may include, or otherwise be in fluid communication with, a manifold connected dampening fluid vapor supply chamber 205. The manifold connected dampening fluid vapor supply chamber 205 may be configured in the shape of a tube-like structure, for example. The manifold connected dampening fluid vapor supply chamber 205 may define an interior for containing a dampening fluid vapor suitable for ink-based digital lithographic printing.

The manifold 201 may include a supply channel 207 for delivering the dampening fluid in a controlled manner to the reimageable surface of the imaging member 209 generally in the manner described above.

The manifold connected dampening fluid vapor supply chamber 205 may be connected to a dampening fluid supply (not shown) via, for example, an air/vapor introduction conduit (see the structure upstream of 250 in FIG. 2) in fluid communication with the manifold connected dampening fluid vapor supply chamber 205 for supplying dampening fluid in an interior of the manifold connected dampening fluid vapor supply chamber 205. The air/vapor introduction conduit may be in a form of a mixing device having an air inlet 210 into which air may be introduced under pressure and/or at an elevated temperature to support the vaporization, entrainment and/or transport of dampening fluid vapor to the manifold connected dampening fluid vapor supply chamber 205. The air/vapor introduction conduit may include a plurality of dampening fluid vapor inlets 220,225 through which a dampening fluid, such as D4, may be introduced. The dampening fluid vapor may be entrained into the stream of pressurized, elevated temperature air moving in direction C from the air inlet 210 to the manifold connected dampening fluid vapor supply chamber 205. The air/vapor introduction conduit and the manifold connected dampening fluid vapor supply chamber 205 may comprise, or otherwise be configured as, a single continuous tube-like structure, as shown.

The structure shown in FIG. 2 is generally effective in introducing an air/vapor mixture of entrained dampening fluid vapor to the manifold connected dampening fluid vapor supply chamber 205 and on downstream to the distribution manifold 207 for introducing a layer of dampening fluid onto the reimageable surface 209 of the imaging member.

Experimentation with structures such as those shown in FIG. 2 focused on modeling and/or measuring a D4 vapor mass fraction distribution on an inner surface of the overall tube-like structure comprising the air/vapor introduction conduit and the manifold connected dampening fluid vapor supply chamber 205. It was noted that the mass fraction distribution was not homogeneous in that an unevenly high concentration of D4 vapor was detected on the inner surface of the air/vapor introduction conduit downstream of the dampening fluid vapor inlets 220,225. A concern that this experimentation raised is that this non-uniformity immediately downstream of the dampening fluid vapor inlets 220, 225 may be expected to cause a non-uniform mass fraction distribution of the dampening fluid ultimately disposed on the reimageable surface of the imaging member. Modeling and/or measuring of a mass fraction distribution of D4 vapor on the plate surface confirmed the concern in that the mass fraction distribution was determined to be higher near a center of the reimageable surface in a transverse direction. These experimental results were considered to highlight the importance of more effectively pre-mixing the D4 vapor and the air in an increasingly homogeneous manner.

Figure 3:
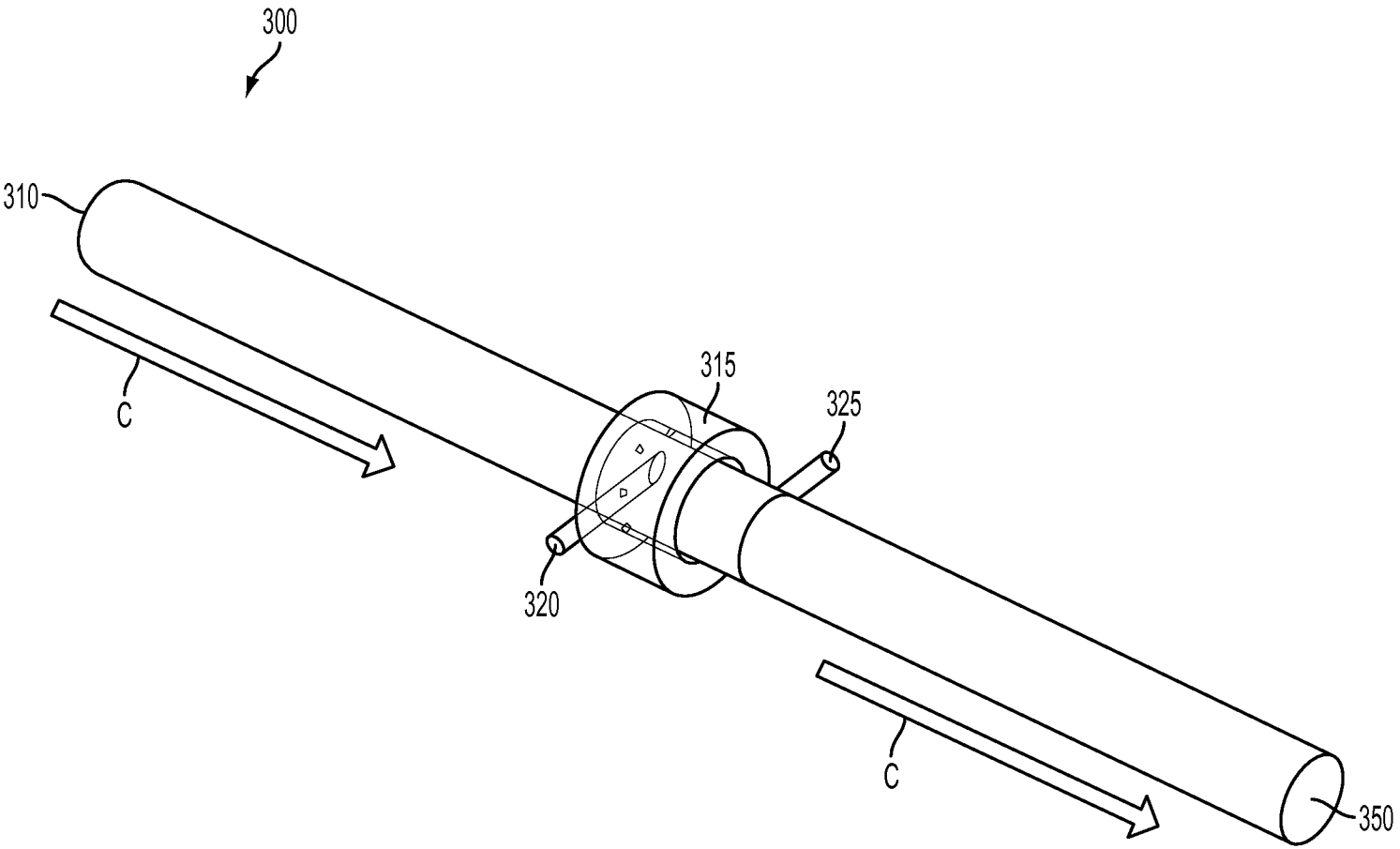
FIG. 3 illustrates a perspective view of a vapor deposition system mixing apparatus in accordance with an exemplary embodiment.

FIG. 3 illustrates a perspective view of an air/vapor deposition system mixing apparatus 300 in accordance with an exemplary embodiment. In particular, FIG. 3 shows an air/vapor deposition system mixing apparatus 300 including an air only flow inlet 310 into which air may be introduced at a controlled mass flow rate and an elevated temperature. In experimentation, the air was introduced into the air/vapor deposition system mixing apparatus 300 at a mass flow rate of about $5.5\times10^{-4}$ kg/s. The air/vapor mixing system apparatus 300 may include a vapor flow exit 350 through which the mixed air and dampening fluid vapor may be directed in direction C to the manifold connected dampening fluid vapor supply chamber (see FIG. 2). A dampening fluid vapor introduction chamber 315 may be disposed at a point along the air/vapor deposition system mixing apparatus 300 between the air only flow inlet 310 and the vapor flow exit 350.

The dampening fluid vapor introduction chamber 315 may include a plurality of dampening fluid vapor chamber inlets 320,325. The plurality of dampening fluid vapor chamber inlets 320,325 are configured to communicate with the dampening fluid vapor introduction chamber 315 so that introduced dampening fluid vapor may flow through the plurality of dampening fluid vapor chamber inlets 320,325 to the dampening fluid vapor introduction chamber 315. In experimentation, a D4 vapor was introduced through the plurality of dampening fluid vapor chamber inlets 320,325 to the dampening fluid vapor introduction chamber 315 for further introduction into the airstream in the air/vapor deposition system mixing apparatus 300 at a mass flow rate of about $6.9\times10^{-5}$ kg/s.

Figure 4:
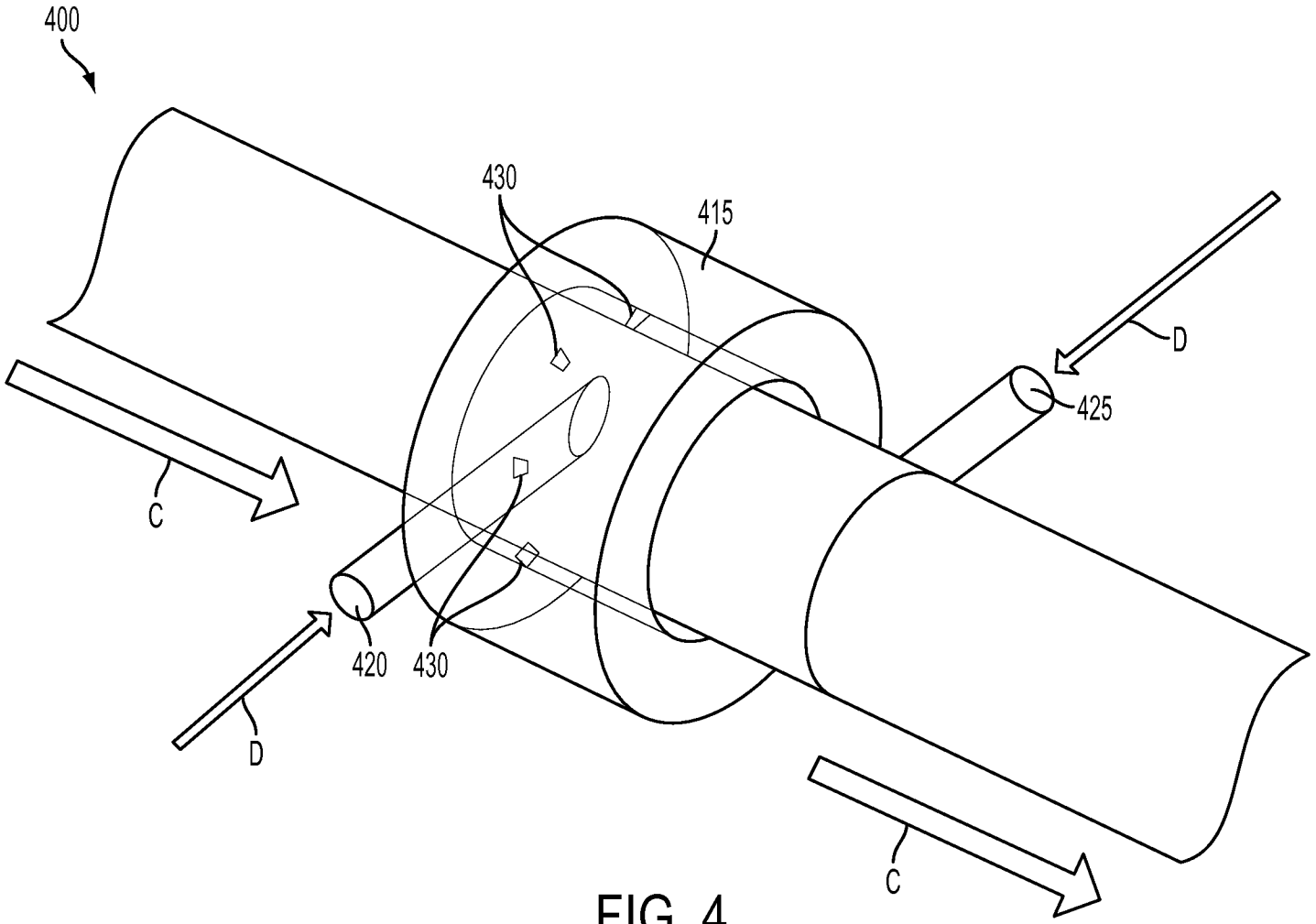
FIG. 4 illustrates a more detailed perspective view of a vapor deposition system mixing apparatus (as shown in FIG. 3) in accordance with an exemplary embodiment.

FIG. 4 illustrates a more detailed perspective view of the air/vapor deposition system mixing apparatus 400 (as shown in FIG. 3) in accordance with an exemplary embodiment. A dampening fluid vapor introduction chamber 415 may include a plurality dampening fluid vapor chamber inlets 420,425. The dampening fluid vapor chamber inlets 420,425 are configured to communicate with the dampening fluid vapor introduction chamber 415 so that dampening fluid vapor introduced from a dampening fluid vapor source (not shown) may flow in direction D through the plurality of dampening fluid vapor chamber inlets 420,425 to the dampening fluid vapor introduction chamber 415. Within the dampening fluid vapor introduction chamber 415, a dampening fluid vapor may be made to circulate in a substantially clockwise direction in the configuration shown in FIG. 4.

The dampening fluid vapor introduction chamber 415 may include a plurality of vapor chamber exits 430 for introducing the dampening fluid vapor into the tube-like structure of the air/vapor deposition system mixing apparatus 400 through which air under pressure and at an elevated temperature flows in direction C. The dampening fluid vapor introduced into the airstream is entrained by the airstream as an air/vapor mixture for delivery to a manifold connected dampening fluid vapor supply chamber via an air/vapor introduction conduit. In order to facilitate this introduction of the dampening fluid vapor into the airstream, the plurality of vapor chamber exits 430, at least four, may be evenly spaced about a circumference of the tube-like structure of the air/vapor deposition system mixing apparatus at an interface of the dampening fluid vapor introduction chamber 415 with the tube-like structure of the air/vapor deposition system mixing apparatus 400. In a preferred embodiment, each of the evenly-spaced plurality of vapor chamber exits 430 may be positioned substantially 30 degrees from a tube surface normal in a direction that may facilitate entrainment of the dampening fluid vapor into the airstream.

A lengthwise dimension of a space interposing the dampening fluid vapor introduction chamber 415 along a length of the tube-like structure of the air/vapor introduction conduit of the air/vapor deposition system mixing apparatus 400 may be about 25 mm. An outer diameter of the dampening fluid vapor introduction chamber 415 around the tube-like structure of the air/vapor deposition system mixing apparatus 400 may be on the order of about 44 mm, with the tube-like structure having a diameter on the of about 24 mm. Dampening fluid vapor may be exhausted into the airstream in the air/vapor introduction conduit of the air/vapor deposition system mixing apparatus 400 by way of the plurality of vapor chamber exits 430, which are small in diameter, having a diameter, for example, of about 1 mm.

Figure 5:
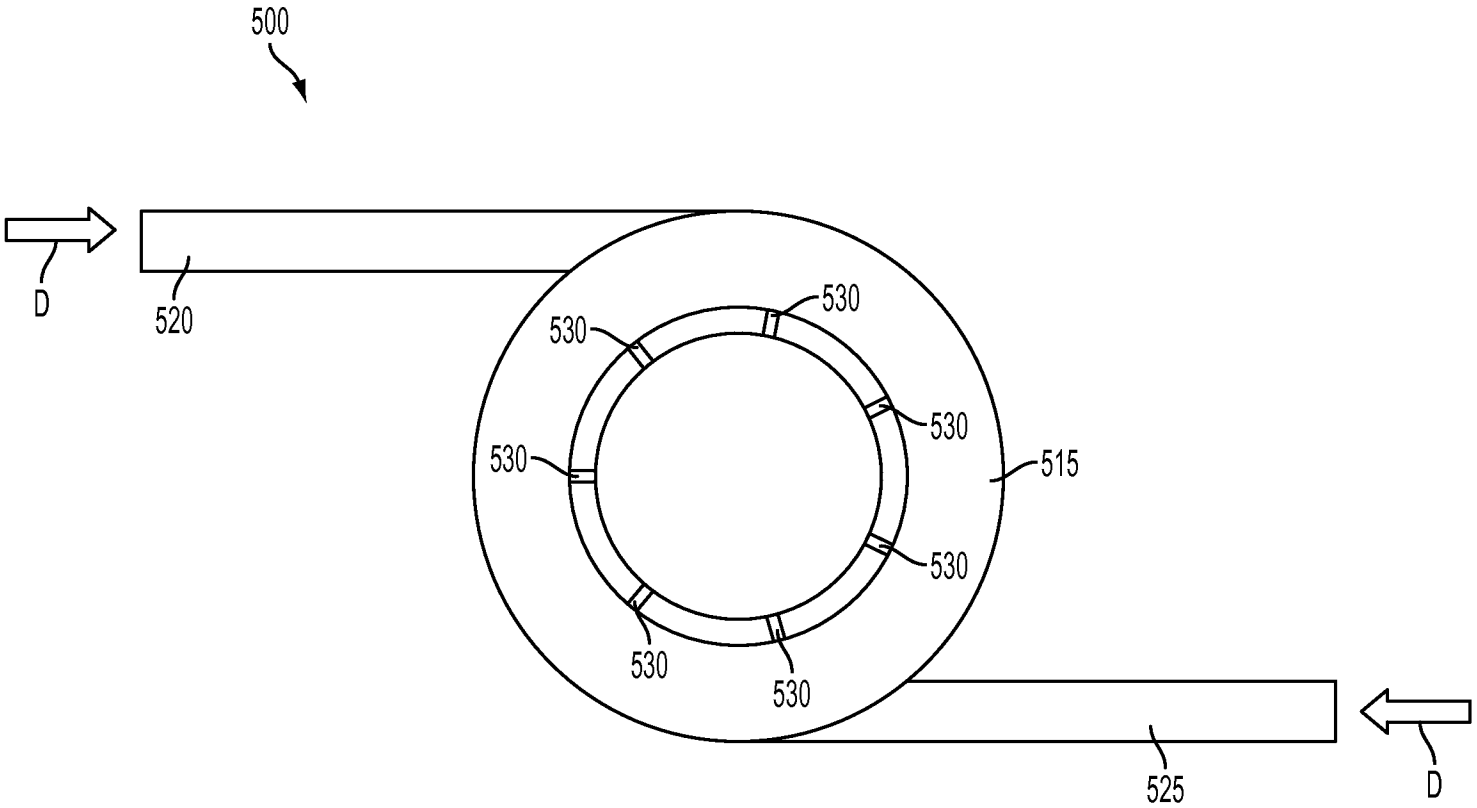
FIG. 5 illustrates an end view of a vapor deposition system mixing apparatus (as shown in other perspectives in FIGS. 3 and 4) in accordance with an exemplary embodiment.

FIG. 5 illustrates an end view of the air/vapor deposition system mixing apparatus 500 (as shown in FIGS. 3 and 4) in accordance with an exemplary embodiment. The dampening fluid vapor introduction chamber 515 may include a plurality of vapor chamber inlets 520,525 configured to communicate with the dampening fluid vapor introduction chamber 515 so that dampening fluid vapor introduced from a dampening fluid vapor source (not shown) may flow in direction D through the vapor chamber inlets 520,525 to dampening fluid vapor introduction chamber 515. The dampening fluid vapor introduction chamber 515 may also include plurality of vapor chamber exits 530 (7 in this embodiment) for introducing the dampening fluid vapor into the tube-like structure of the air/vapor introduction conduit of the air/vapor deposition system mixing apparatus 500 through which a flow of air under pressure and at an elevated temperature flows. The dampening fluid vapor introduced into the airstream is entrained by the airstream as an air/vapor mixture. As shown in FIG. 5, the plurality of vapor chamber exits 530 may be evenly spaced about a circumference of the tube-like structure of the air/vapor introduction conduit of the air/vapor deposition system mixing apparatus 400 at an interface of the dampening fluid vapor introduction chamber 515 with the tube-like structure of the mixing apparatus 500.

A configuration as shown in FIGS. 3-5 has been experimentally determined to enable uniform mass fraction distribution of the dampening fluid entrained in the airstream at a distance of three to four tube diameters downstream from the vapor chamber exits 530 of the dampening fluid vapor introduction chamber 515. Excellent mass fraction distribution was obtained with this manifold configuration and with the air and dampening fluid vapor being pre-mixed. In this configuration, pressure drop in the tube-like structure is minimal and an operating pressure of the mixing apparatus is below 1 inch w.g. for a given flow rate. Vapor mixing system temperature distribution is substantially uniform, and the temperature of the air/vapor mixture is substantially uniform for introduction downstream to a manifold connected dampening fluid vapor supply chamber.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A dampening fluid delivery device, comprising:

a dampening fluid supply chamber;

a dampening fluid supply channel positioned downstream of the dampening fluid supply chamber in fluid communication with the dampening fluid supply chamber, the dampening fluid supply channel delivering dampening fluid onto a reimageable surface of an imaging member;

an air and vapor mixing conduit positioned upstream of the dampening fluid supply chamber in fluid communication with the dampening fluid supply chamber, the air and vapor mixing conduit having an air inlet for generating a flow of air on an interior of the air and vapor conduit; and a dampening fluid vapor mixing chamber, the dampening fluid vapor mixing chamber arranged around an entire circumferential surface of a section of the air and vapor mixing conduit at a position downstream of the air inlet and upstream of the dampening fluid supply chamber, the dampening fluid vapor mixing chamber having a plurality of dampening fluid vapor inlets, and a plurality of vapor exit ports that are aligned with openings in the air and vapor mixing conduit that connect with an interior of the air and vapor mixing conduit, the dampening fluid vapor entering the dampening fluid vapor mixing chamber via the plurality of dampening fluid vapor inlets and exiting the dampening fluid vapor mixing chamber through the plurality of vapor exit ports directing the dampening fluid vapor toward an axial center of the air and vapor mixing conduit to entrain the dampening fluid vapor in the generated flow of air.

2. The dampening fluid delivery device of claim 1, the dampening fluid vapor mixing chamber having at least four vapor exit ports.

3. The dampening fluid delivery device of claim 1, the dampening fluid vapor mixing chamber having seven vapor exit ports.

4. The dampening fluid delivery device of claim 1, the plurality of vapor exit ports being evenly spaced around a circumferential body of the air and vapor mixing conduit.

5. The dampening fluid delivery device of claim 1, the plurality of vapor exit ports being oriented at about 30 degrees with respect to a plane orthogonal to a longitudinal axis of the air and vapor mixing conduit.

6. The dampening fluid delivery device of claim 1, the plurality of dampening fluid vapor inlets being oriented to introduce the dampening fluid vapor into the dampening fluid vapor mixing chamber in a direction substantially orthogonally to a longitudinal axis of the air and vapor mixing conduit.

7. The dampening fluid delivery device of claim 1, a diameter of the air and vapor mixing conduit being about 24 mm.

8. The dampening fluid delivery device of claim 1, a diameter of the dampening fluid vapor mixing chamber in a direction orthogonal to a longitudinal axis of the air and vapor mixing conduit being about 44 mm.

9. The dampening fluid delivery device of claim 1, a width of the dampening fluid vapor mixing chamber in a direction parallel to a longitudinal axis of the air and vapor mixing conduit being about 25 mm.

10. A method for delivering dampening fluid in an image forming system, comprising:

providing an air and vapor mixing conduit in an image forming system, the air and vapor mixing conduit having a tube structure;

supplying air, under pressure, to the air and vapor mixing conduit to generate a flow of air along a longitudinal axis on an interior of the air and vapor mixing conduit;

providing a dampening fluid vapor mixing chamber arranged around an entire circumferential surface of a section of the air and vapor mixing conduit at a position downstream of an air inlet;

supplying a dampening fluid to the dampening fluid supply chamber via a plurality of dampening fluid vapor inlets;

exhausting the dampening fluid from the dampening fluid supply chamber to the interior of the air and vapor mixing conduit via a plurality of vapor exit ports that are aligned with openings in the air and vapor mixing conduit that connect with the interior of the air and vapor mixing conduit, the dampening fluid being directed toward an axial center of the air and vapor mixing conduit;

entraining the dampening fluid in the generated flow of air as a mixture;

communicating the mixture via a fluid communication system from the air and vapor mixing conduit to a surface of an imaging member in the image forming system; and depositing the dampening fluid on the surface of the imaging member.

11. The method of claim 10, the fluid communication system comprising at least a dampening fluid supply chamber, and a dampening fluid supply channel positioned downstream of the dampening fluid supply chamber in fluid communication with the dampening fluid supply chamber, the dampening fluid supply channel delivering the dampening fluid onto a reimageable surface of the imaging member.

12. The method of claim 10, the dampening fluid vapor mixing chamber having at least four vapor exit ports.

13. The method of claim 10, the dampening fluid vapor mixing chamber having seven vapor exit ports.

14. The method of claim 10, the plurality of vapor exit ports being evenly spaced around a circumferential body of the air and vapor mixing conduit.

15. The method of claim 10, the plurality of vapor exit ports being oriented at about 30 degrees with respect to a plane orthogonal to the longitudinal axis of the air and vapor mixing conduit.

16. The method of claim 10, the plurality of dampening fluid vapor inlets being oriented to introduce the dampening fluid into the dampening fluid vapor mixing chamber in a direction substantially orthogonally to a longitudinal axis of the air and vapor mixing conduit.

17. The method of claim 10, a diameter of the air and vapor mixing conduit being about 24 mm.

18. The method of claim 10, a diameter of the dampening fluid vapor mixing chamber in a direction orthogonal to a longitudinal axis of the air and vapor mixing conduit being about 44 mm.

19. The method of claim 10, a width of the dampening fluid vapor mixing chamber in a direction parallel to a longitudinal axis of the air and vapor mixing conduit being about 25 mm.

20. An image forming system, comprising:

an imaging member having a reimageable surface; and dampening fluid delivery device for delivering a dampening fluid on the reimageable surface of the imaging member, comprising:

a dampening fluid supply chamber, a dampening fluid supply channel positioned downstream of the dampening fluid supply chamber in fluid communication with the dampening fluid supply chamber, the dampening fluid supply channel delivering dampening fluid onto the reimageable surface, an air and vapor mixing conduit positioned upstream of the dampening fluid supply chamber in fluid communication with the dampening fluid supply chamber, the air and vapor mixing conduit having an air inlet for generating a flow of air on an interior of the air and vapor mixing conduit; and a dampening fluid vapor mixing chamber, the dampening fluid vapor mixing chamber being arranged around an entire circumferential surface of a section of the air and vapor mixing conduit at a position downstream of the air inlet and upstream of the dampening fluid supply chamber, the dampening fluid vapor mixing chamber having a plurality of dampening fluid vapor inlets, and a plurality of vapor exit ports that are aligned with openings in the air and vapor mixing conduit that connect with an interior of the air and vapor mixing conduit, the dampening fluid vapor entering the dampening fluid vapor mixing chamber via the plurality of dampening fluid vapor inlets and exiting the dampening fluid vapor mixing chamber through the plurality of vapor exit ports directing the dampening fluid vapor toward an axial center of the air and vapor mixing conduit to entrain the dampening fluid vapor in the generated flow of air.

* * * * *